US008464678B1

(12) United States Patent
Iskenderian

(10) Patent No.: US 8,464,678 B1
(45) Date of Patent: Jun. 18, 2013

(54) ROLLER VALVE LIFTER

(75) Inventor: Ronald Michael Iskenderian, Gardena, CA (US)

(73) Assignee: Ed Iskenderian Racing Cams, Gardena, CA (US)

( * ) Notice: Subject to any disclaimer, the term of this patent is extended or adjusted under 35 U.S.C. 154(b) by 257 days.

(21) Appl. No.: 12/316,214

(22) Filed: Dec. 9, 2008

Related U.S. Application Data

(60) Provisional application No. 61/008,052, filed on Dec. 18, 2007.

(51) Int. Cl.
*F01L 1/14* (2006.01)

(52) U.S. Cl.
USPC ..... 123/90.48; 123/90.52; 123/90.33; 74/569

(58) Field of Classification Search
USPC 123/90.5, 90.52, 90.48, 90.35, 90.33; 74/569
See application file for complete search history.

(56) References Cited

U.S. PATENT DOCUMENTS

| | | | | | |
|---|---|---|---|---|---|
| 3,628,514 | A * | 12/1971 | Phillips | ..... | 123/90.48 |
| 4,708,102 | A * | 11/1987 | Schmid | ..... | 123/90.35 |
| 4,809,651 | A * | 3/1989 | Gerchow et al. | ..... | 123/90.5 |
| 5,022,356 | A | 6/1991 | Morel, Jr. | | |
| 5,127,374 | A | 7/1992 | Morel, Jr. | | |
| 5,178,107 | A | 1/1993 | Morel, Jr. | | |
| 6,196,175 | B1 * | 3/2001 | Church | ..... | 123/90.16 |

* cited by examiner

*Primary Examiner* — Zelalem Eshete
(74) *Attorney, Agent, or Firm* — Dennis W. Beech

(57) ABSTRACT

The present invention may be used for vehicle engines having bores in which roller valve lifters reciprocate. A roller valve lifter may have a body with two opposed subtending spaced apart legs. A cam follower roller bearing having a press fit inner sleeve bushing may be rotatably mounted on the pin. Each of the legs may have an oil feed hole that traverses from an exterior surface to an interior surface adjacent to the inner sleeve bushing. The body in an upper portion may have a key device or an attached vertical guide bar to maintain proper orientation of the roller valve lifter to a cam lobe.

11 Claims, 2 Drawing Sheets

ROLLER VALVE LIFTER

CROSS-REFERENCE TO RELATED APPLICATIONS

This application claims the benefit of U.S. Provisional Application No. 61/008,052, filed Dec. 18, 2007.

BACKGROUND OF THE INVENTION

This invention relates to devices for land vehicle engines and more specifically to roller valve lifter assemblies or roller cam followers for high load engines that may include high speed automotive racing engines. The new roller cam follower incorporates a sleeved bushing plane cam follower bearing with an oil pressure lubricating system.

In the field of high performance engines, roller cam followers or valve lifters typically have needle or pin roller cam follower bearings. These bearings may be designed for side lubrication or other lubrication methods and may be prone to short life or premature failure when subjected to relatively high valve spring loads and rpm levels because the needle rollers may be the weakest link. The easily compromised needle rollers may be subject to rapid erosion and the resulting increase in radial bearing clearance may cause catastrophic failure of a cam follower bearing, valve lifter or other critical engine components.

A known use of a plane bearing or bushing in place of the traditional needle or pin roller bearing is disclosed in U.S. Pat. Nos. 5,127,374 and 5,178,107 for use in an internal combustion engine block used in high speed motor vehicles having open-ended cylindrical bores in which valve lifters reciprocate. A roller may have a bushing press fit therein for the bushing to rotate on an axle or pin of a roller valve lifter. However, because such a bearing may require a generous supply of constant lubrication to the interior surface, a lubrication oil passage is formed within the pin or axle that may be a V-shape. The lubrication oil passage may compromise the integrity of the pin by weakening it substantially and may create a significant stress riser formed at the intersection of two holes drilled to form a V-shaped passage. The teaching is to deliver oil to the center of the bearing and axle interface. This may cause low reliability in a high speed automotive motor vehicle engine due to the harsh environment of heavy valve spring loads and impact forces due to valve float. These two patents were issued approximately fifteen years ago and to applicant's knowledge as one involved in vehicle motor engine designs, this disclosed invention has not found use in high speed motor vehicle engines.

SUMMARY OF THE INVENTION

The present invention is directed to devices for vehicle engines having bores in which roller valve lifters reciprocate. A roller valve lifter may have a body with two opposed subtending spaced apart legs. A cam follower roller bearing having a press fit inner sleeve bushing may be rotatably mounted on the pin. Each of the legs may have an oil feed hole that traverses from an exterior surface to an interior surface adjacent to the inner sleeve bushing. The body in an upper portion may have a key device or an attached vertical guide bar to maintain proper orientation of the roller valve lifter to a cam lobe.

These and other features, aspects and advantages of the present invention will become better understood with reference to the following drawings, description and claims.

DETAILED DESCRIPTION

Figure 3:
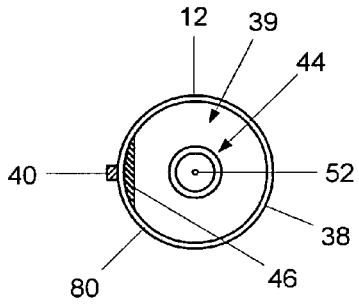
FIG. 3 illustrates a top end view of a roller valve lifter according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4, a roller valve lifter 10 or roller cam follower may have a body 12 with a cam follower bearing 14, outer bearing race or roller with an inner sleeve bushing 16 or inner bearing race. The body 12 may have two opposed and spaced apart subtending legs 18 at the body 12 lower portion. The legs 18 may each have a pin aperture 20 for receipt of a pin 22 or axle to be inserted and retained approximately orthogonal to the body 12 longitudinal axis. For assembly the pin 22 is inserted through the pin apertures 20 and the inner sleeve bushing 16 aperture 26. The pin 22 may be attached at one or both ends 24 by compression of material or other method to rigidly fix the pin 22 to the legs 18. Based on experiments it has been found a clearance of 0.004 or less between the inner sleeve bushing 16 and the pin 22 gives reliable performance.

The inner sleeve bushing 16 may rotate on the pin 22. Lubricating oil may be channeled to the inner sleeve bushing 16 through oil feed holes 30 formed in each leg 18 to traverse from the leg 18 exterior surface 32 through the interior surface 34. There may be a flat surface 36 formed longitudinally at the top of the pin 22. The gap formed between the pin 22 and inner sleeve bushing 16 may allow lubricant to flow between the pin and bushing. The oil feed holes 30 may receive lubricant from an engine block oil pressure source in either a constant or intermittent basis and the input at the exterior surface 32 may be positioned depending on the engine type and oil delivery system.

The inner sleeve bushing 16 may be press fitted into the cam follower bearing 14 to prevent slippage. The pin 22 may have a hardened diamond like coating as may the inner sleeve bushing 16 aperture 26 wall to resist abrasive wear. The pin 22 and inner sleeve bushing 16 may be formed of material to resist wear in high performance engines when oil is injected at the aperture 26 of the bushing 16 via oil feed holes 30.

Referring to FIGS. 1 through 6, the roller valve lifter 10 may have a key device 40 attached to a side wall 38 of the body 12 at the upper portion or cavity 39. The key device 40 may be rectangular, cylindrical or other geometric shape and may be positioned to slidably engage a slot or groove formed in an engine bore for roller valve lifters 10. The engine lifter bore may be fitted with a sleeve press fit into the bore so that the key device 40 may engage a slot or groove in the sleeve rather than the lifter bore itself. The key device 40 may be positioned approximately above one of the pin 22 ends 24 as the roller valve lifter 10 may experience increased force orthogonal to the longitudinal axis of the pin 22. The key device 40 constrained in an engine bore groove may maintain proper positioning of the cam follower bearing 14 with respect to a cam lobe of an engine cam shaft.

When the key device 40 may be attached in an aperture 42 in the side wall 38 of the body 12, a washer pad 46 may be positioned against the interior surface 48 of the side wall 38. A second aperture 43 may be positioned opposite aperture 42 for use in attaching a key device 40 or for attachment of a second key device.

Figure 4:
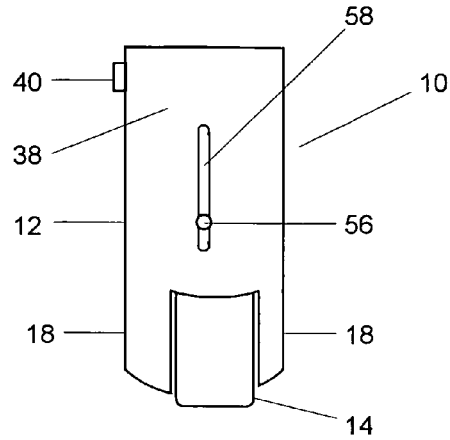
FIG. 4 illustrates a side elevation view of a roller valve lifter according to an embodiment of the invention.
Figure 2:
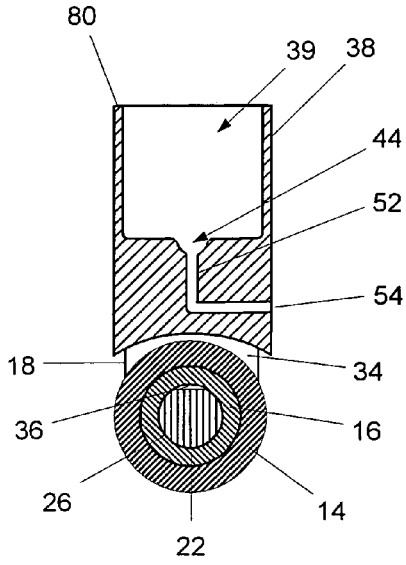
FIG. 2 illustrates a side cross-sectional elevation view of a roller valve lifter according to an embodiment of the invention.
Figure 1:
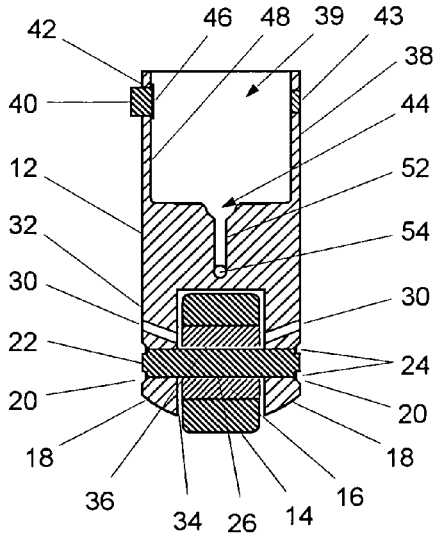
FIG. 1 illustrates a side cross-sectional elevation view of a roller valve lifter according to an embodiment of the invention.
Figure 6:
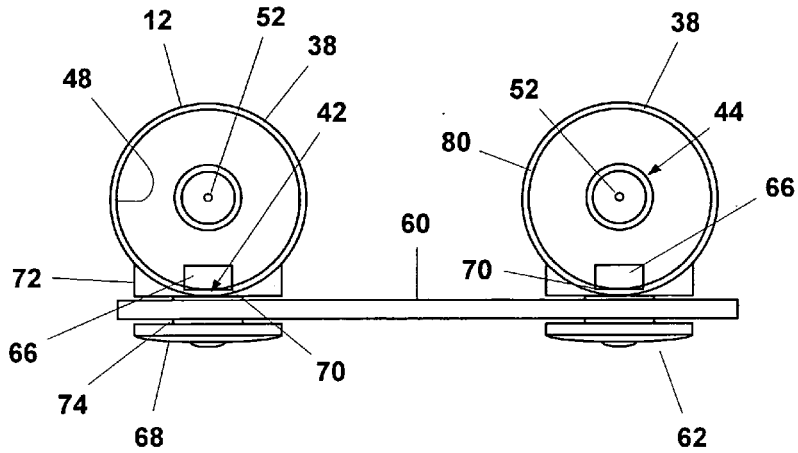
FIG. 6 illustrates a top end view of a pair of connected roller valve lifters according to an embodiment of the invention.
Figure 5:
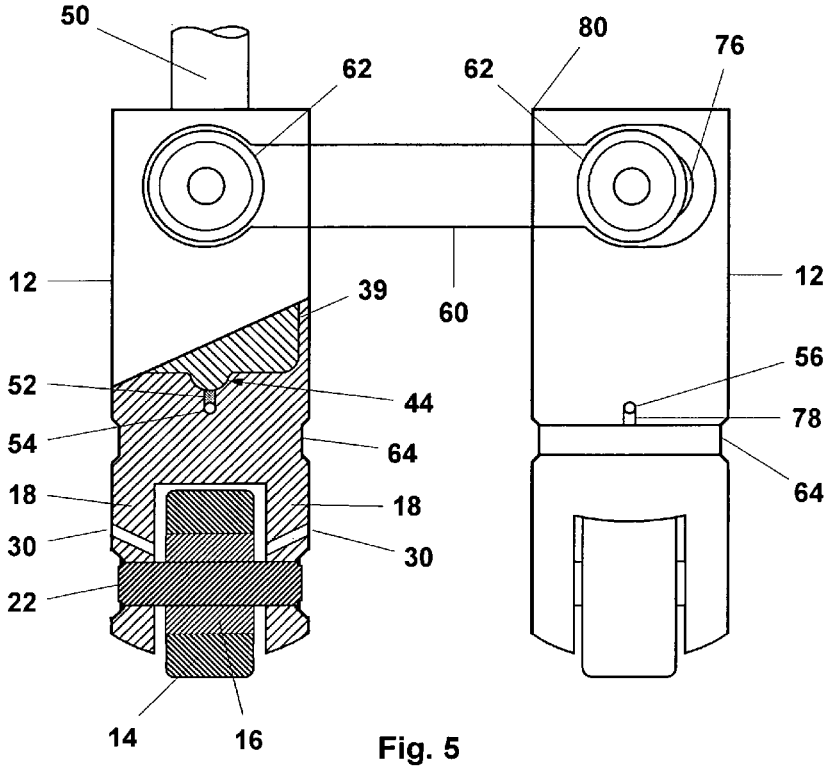
FIG. 5 illustrates a side partial cross-sectional elevation view of a pair of connected roller valve lifters according to an embodiment of the invention.

The cavity 39 may have a conventional tubular or solid pushrod 50 positioned therein. The pushrod seat 44 may be centered as illustrated or may be offset from a longitudinal centerline of the body 12. The cam follower bearing 14 may also be offset as best illustrated in FIG. 4. Lubrication oil may be channeled to the pushrod seat 44 through vertical oil passage 52 from the body orthogonal passage 54 that may have an input opening 56 in communication with an oil slot 58 formed in body 12. The oil slot 58 may be formed to always be in communication with an engine oil pressure source regardless of the position of the roller valve lifter 10. The oil slot 58 and passage 54 may be located in the body 12 depending on the specific engine block.

The roller valve lifters 10 may also be maintained in proper orientation in an engine block bore by use of a vertical guide bar 60 attached between pairs of lifters 10 instead of a key device 40. A vertical guide bar 60 may be attached at apertures 42 with an attachment spool 62. In this embodiment the body 12 may have a relief band 64 formed as a circumferential groove in the body 12. The relief band 64 may be positioned for communication with the engine block oil pressure source no matter the position of the body 12 in the engine bore. The input opening 56 of the orthogonal passage 54 may receive edge orifice metered oil from relief band 64 without the need for an oil slot 58. For cases where increased oil delivery is necessary there may be a depression or narrow slot 78 formed between relief band 64 and input opening 56.

The attachment spool 62 may have a cap screw 66 inserted through aperture 42 and vertical guide bar 60. The aperture 42 may be formed orthogonal to the pin 22 adjacent the top of the body 12. A spot faced counter bore 70 may be formed on interior surface 48 to seat cap screw 66. A cap base 72 may be positioned between the body 12 and the vertical guide bar 60. Threaded cap 68 may be threadably attached to the cap screw 66 to abut a shoulder 74 protruding from the cap base 72 through the bar slot 76 in the vertical guide bar 60. The cap screw 66 may be riveted to the threaded cap 68 to strengthen the attachment. The shoulder 74 may be approximately 0.003 to 0.005 inches longer than the vertical guide bar 60 is thick to allow movement of the vertical guide bar 60.

A compression spring may be positioned in the cavity 39 to pre-load each lifter to its cam lobe as may be understood in the art. A compression spring may also be positioned on the upper edge 80 of the side wall 38.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for vehicle engines having bores in which valve lifters reciprocate comprising:

a roller valve lifter with a body and a cam follower bearing rotatably disposed on a pin attached to two opposed spaced apart legs wherein each of said legs has a pin aperture for receipt of said pin and each end of said pin is rigidly attached to one of said legs;

an inner sleeve bushing press fit into said cam follower bearing to be disposed between said pin and said cam follower bearing and said inner sleeve bushing having a bearing aperture spaced apart from said pin; and at least one of said legs having an oil feed hole traversing from an exterior surface to an interior surface to open adjacent said inner sleeve bushing.

2. The device as in claim 1 where said pin has a flat surface on an upper longitudinal portion of said pin between said two opposed spaced apart legs.

3. The device as in claim 1 wherein a key device is attached in an upper portion of said body disposed for engaging an engine bore slot of a vehicle engine.

4. The device as in claim 3 wherein said key device is attached in a side wall having an aperture therein of said body with a washer pad positioned on an interior surface of said side wall.

5. The device as in claim 1 wherein a pushrod seat in an upper portion of said body has an approximately vertical oil passage descending from a bottom surface to communicate with an orthogonal passage having an input opening in said body exterior surface.

6. The device as in claim 5 wherein said input opening is disposed in an oil slot having a generally vertical longitudinal axis for communication with an engine oil pressure source.

7. The device as in claim 5 wherein a relief band is formed circumferentially in said body exterior surface disposed for said input opening to receive edge orifice metered oil from said relief band.

8. The device as in claim 1 wherein a vertical guide bar is attached to an upper portion of two roller valve lifters wherein each end of said vertical guide bar having a bar slot for slidable engagement with an attachment spool attached to said body of each roller valve lifter.

9. The device as in claim 8 wherein said attachment spool comprising:

a cap screw insertable through a side wall having an aperture therein;

a cap base disposed on said cap screw adjacent an exterior surface of said body and a hollow shoulder of said cap base extending outwardly for receipt of said bar slot; and a threaded cap for threadable attachment to said cap screw to abut said hollow shoulder to retain said vertical guide bar.

10. The device as in claim 9 wherein said cap screw is riveted to said threaded cap.

11. The device as in claim 1 wherein said inner sleeve bushing is spaced apart from said pin by approximately 0.004 inches or less.

* * * * *